US005338499A

United States Patent [19]

Ryynänen

[11] Patent Number: 5,338,499

[45] Date of Patent: Aug. 16, 1994

[54] METHOD FOR THE FABRICATION OF A COMPOSITE STRUCTURE

[75] Inventor: Seppo I. Ryynänen, Kouvola, Finland

[73] Assignee: Gerestek Oy, Finland

[21] Appl. No.: 121,891

[22] Filed: Sep. 16, 1993

Related U.S. Application Data

[63] Continuation of Ser. No. 842,411, Mar. 26, 1992, abandoned.

[30] Foreign Application Priority Data

Sep. 29, 1989 [FI] Finland ..... 894535
Sep. 29, 1989 [FI] Finland ..... 894536

[51] Int. Cl.[5] ..... B28B 19/00; E04B 1/16

[52] U.S. Cl. ..... 264/34; 52/87; 52/88; 52/334; 52/336; 52/741.1; 52/745.05; 264/32; 264/35; 264/251; 264/254; 264/256; 264/265; 264/274; 264/277; 264/279; 264/279.1; 264/308; 264/309

[58] Field of Search ..... 264/308, 309, 31–36, 264/251, 254, 256, 265, 273, 274, 277, 279, 279.1; 52/87, 88, 334, 336, 741.1–741.4, 745.05

[56] References Cited

U.S. PATENT DOCUMENTS

| | | | |
|---|---|---|---|
| Re. 13,775 | 7/1914 | Church | 264/32 |
| 1,614,570 | 1/1927 | Pawling | 52/334 |
| 1,876,205 | 9/1932 | Crom | 264/31 |
| 2,096,629 | 10/1937 | Farrar et al. | 52/334 |
| 2,187,224 | 1/1940 | Cory | 264/31 |
| 2,245,688 | 6/1941 | Krueger | 52/88 |
| 2,315,895 | 4/1943 | Crom | 264/309 X |
| 2,337,743 | 12/1943 | Deuel | 264/309 X |
| 2,611,944 | 9/1952 | Bailey | 264/34 |
| 2,806,277 | 9/1957 | Hand et al. | 264/309 X |
| 2,857,648 | 10/1958 | March | 264/32 |
| 3,003,290 | 10/1961 | Lerner . | |
| 3,027,687 | 4/1962 | Baroni | 52/334 |
| 3,181,187 | 5/1965 | Kahn | 52/334 |
| 3,362,121 | 1/1968 | Weber | 52/334 |
| 3,397,497 | 8/1968 | Shea et al. | 52/334 |
| 3,559,355 | 2/1971 | Day, Jr. . | |
| 3,619,437 | 1/1971 | McDonald, Jr. | 264/309 X |
| 3,622,656 | 11/1971 | Dewey, Jr. et al. | 264/309 X |
| 3,705,228 | 12/1972 | Mattingly | 264/308 X |
| 3,812,636 | 5/1974 | Albrecht et al. | 52/334 |
| 4,129,917 | 6/1978 | Sivachenko et al. | 52/334 X |
| 4,144,369 | 3/1979 | Wass | 52/334 X |
| 4,155,967 | 5/1979 | South et al. | 264/309 X |
| 4,192,120 | 3/1980 | Richard et al. | 52/87 X |
| 4,333,280 | 6/1982 | Morton | 52/336 X |
| 4,527,372 | 7/1985 | Ryan | 52/334 |
| 4,558,550 | 12/1985 | Marchais et al. | 52/309.7 |
| 4,565,661 | 1/1986 | Michienzi . | |
| 4,579,785 | 4/1986 | Karoubas | 52/334 X |
| 4,678,157 | 7/1987 | Fondiller . | |
| 4,785,600 | 11/1988 | Ting | 52/334 |
| 4,882,889 | 11/1989 | Healy et al. | 52/336 |
| 5,016,411 | 5/1991 | Thorsnes | 52/336 X |

FOREIGN PATENT DOCUMENTS

| | | |
|---|---|---|
| 2176818A | 6/1985 | United Kingdom . |
| 83/02475 | 7/1983 | World Int. Prop. O. . |

*Primary Examiner*—Karen Aftergut
*Attorney, Agent, or Firm*—Ostrolenk, Faber, Gerb & Soffen

[57] ABSTRACT

A method for the fabrication of a composite structure made from a profile plate and concrete. The relatively lightweight steel profile plate is placed at the building site. At the building site the concrete is sprayed on the surface of the profile plate to form the composite structure. The profile plate can be sprayed with concrete, layer by layer, with each layer being allowed to at least partially set between sprayings. Thus, the inherent load-bearing capacity of the structure increases as the layers are applied and the weight of the structure increases.

17 Claims, 12 Drawing Sheets

FIG. 10
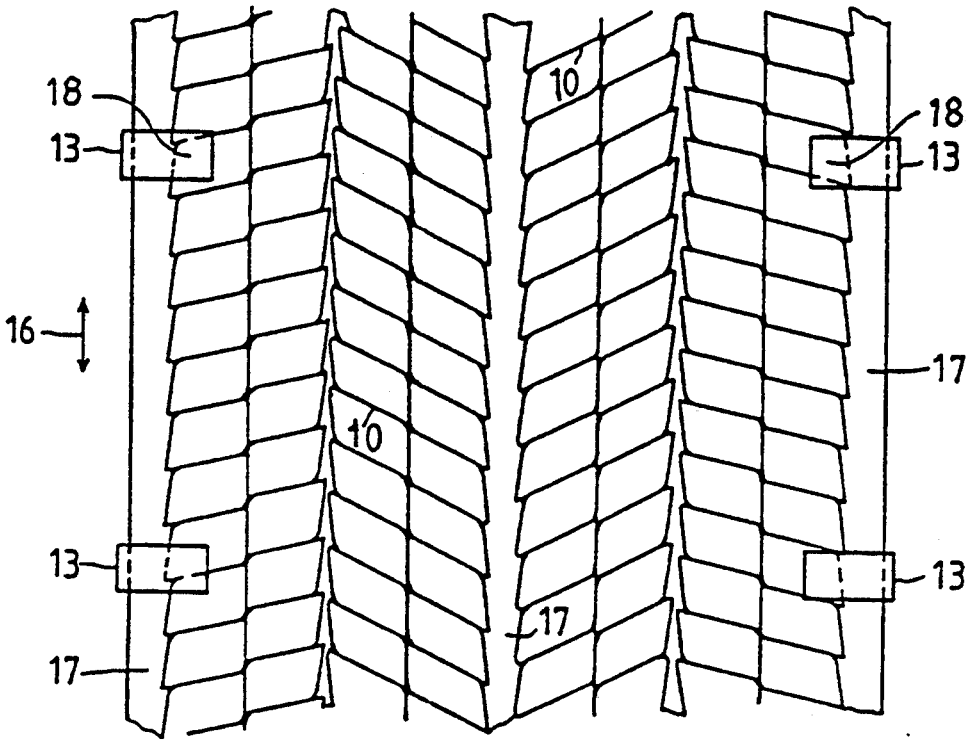
FIG. 11
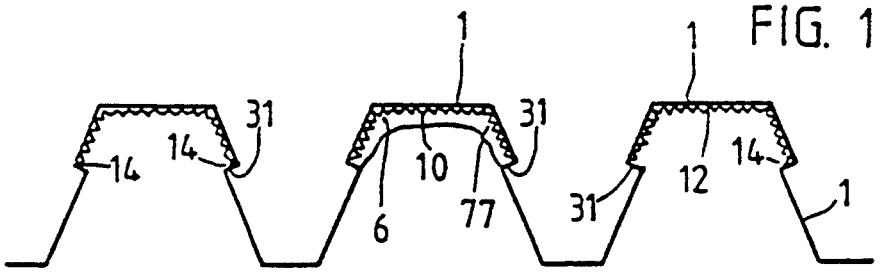
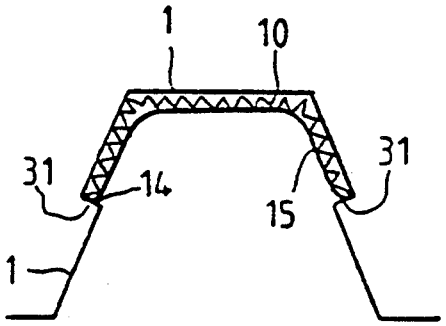
FIG. 12

METHOD FOR THE FABRICATION OF A COMPOSITE STRUCTURE

This is a continuation of application Ser. No. 07/842,411 filed on Mar. 26, 1992, now abandoned.

BACKGROUND OF THE INVENTION

1. Field of the Invention

The present invention relates to a method for the fabrication of a composite structure for various building components.

2. Description of the Prior Art

The use of composite structures is known, as such since the combination of a shaped plate and concrete can be employed for building preferred composite structures, wherein a generally steel profile plate, serves as a component more resistant to tensile stresses, and concrete, on the other hand, which serves as a structural component primarily taking up compressive forces. These type of composite structures have been disclosed, e.g. in Patent publications FI 57295, GB 1 469 478, DE 24 13 645 and DE 26 04 998. The profile plate often serves as a mold for pouring the concrete mass thereon. The grip between the concrete and profile plate can be improved by means of various holes and knobs and recesses made in the profile plate. Tensile stresses can be taken up also by means of various additional steels. Patent publications U.S. Pat. No. 4,121,943 and U.S. Pat. No. 4,559,276 disclose a method for manufacturing steel-fiber concrete, wherein the tensile stresses of concrete are transferred to thin fibers mixed in the concrete. Also known is the injection of concrete by several different applications.

A drawback in the prior known manufacturing methods of composite structures is that they are restricted to substantially horizontal position, casting technique and one-sided loading. Another drawback is the use of generally just one type of concrete in various parts of a structure and the production of unnecessarily thick structures. This results in a structure having a relatively heavy dead weight and yet a relatively low strength. In many applications, it is necessary to use temporary molds and support stands on the construction site and those must be subsequently disassembled. The profile plate in itself is not sufficiently strong enough to serve as a casting mold under a fresh concrete mass without additional reinforcement.

Several composite structures require the use of conventional concrete reinforcements which increases costs. The conventional iron-bar reinforcement of concrete does not often work in an optimum fashion due to position and shape. Too much expensive steel is generally used in view of what is actually needed, since the steel is often not positioned exactly where the tensions are. In prior known composite structures, the freedom of designing the end product is also limited due to the working technique. Fixing of additional components to the structure is inconvenient.

As a result of the inconvenience of the prior known fabrication methods of composite structures, it is in many cases preferable to manufacture elements in a factory and carry them to the construction site to be erected. This, however, leads to the inconvenience of having to carry around heavy building elements that might be damaged during transport. Heavy-duty transport and lifting equipment cannot be brought to every construction site, thus incurring extra costs.

SUMMARY OF THE INVENTION

An object of this invention is to alleviate the above drawbacks, this is accomplished by a method of the present invention which comprises the spraying of concrete to a profile plate.

The equipment intended for carrying out a method of the invention is described later in the claims.

A large number of various applications can be found for the invention. The accompanying drawings only serve as examples and to illustrate one embodiment of the invention.

BRIEF DESCRIPTION OF THE DRAWINGS

FIG. 10 is a cross-sectional view along the line X—X of FIG. 8.

FIG. 11 is a cross-sectional view of the invention prior to injection and partially injected.

FIG. 12 shows one alternative arrangement of the section cross-section of FIG. 11.

DESCRIPTION OF THE PREFERRED EMBODIMENTS

The essential purpose of this invention is to provide a composite structure of concrete and steel, by injecting concrete on to the surface of a profile plate for increasing the thickness of the structure during injection. The forceful striking of shotcrete on a substrate provides a good compaction and creates superior concrete strength, as compared to cast concrete. Thus, if desired, a method of the invention can be used to produce thin and stable composite structures. Shotcreting or concrete spraying provides also the possibility of designing the end product in a variety of shapes.

The invention can be readily applied to produce even large building components in a manner that the actual structure is formed at the actual construction site, from injection or spraying layers. Heavy elements or other major components need not be moved around. The work can be performed by means of relatively small-scale and simple spraying equipment. The profile plate consists of a thin and relatively light material, so it can be readily handled at the construction site, without the added weight of the concrete.

If desired, the structure can be formed by using a variety of concrete layers for providing the end product with desired qualities. The structural components susceptible to tensile stresses can be injected e.g. from fibrous concrete and the components susceptible to noise can be made of a noise-absorbing porous material. The noise-absorbing or structure-lightening material can be a porous concrete containing light concrete or foam mortar. The mass to be sprayed or injected can be made of admixed cement or concrete-coated bits of cellular plastic or pieces of wood for increased porosity.

The profile plate serves as a part of the reinforcement in the final structure but, whenever necessary, it is possible to place between the various injection layers some extra reinforcements, e.g. reinforcing meshes located generally at the points of severest stresses, including common ribbed bar reinforcement, prestressed steels, etc. The reinforcement can be added stepwise during construction, as the preceding concrete layers are set and capable of bearing the subsequently added mass.

The spraying of concrete can be effected conventionally by application via a dry-spraying process or a wet-spraying process.

In many cases, the invention can be used to avoid the building of stands and molds and, thus, to achieve cost savings. The already set shotcrete layers serve partially as a mold for subsequent layers, together with a profile plate.

Figure 1:
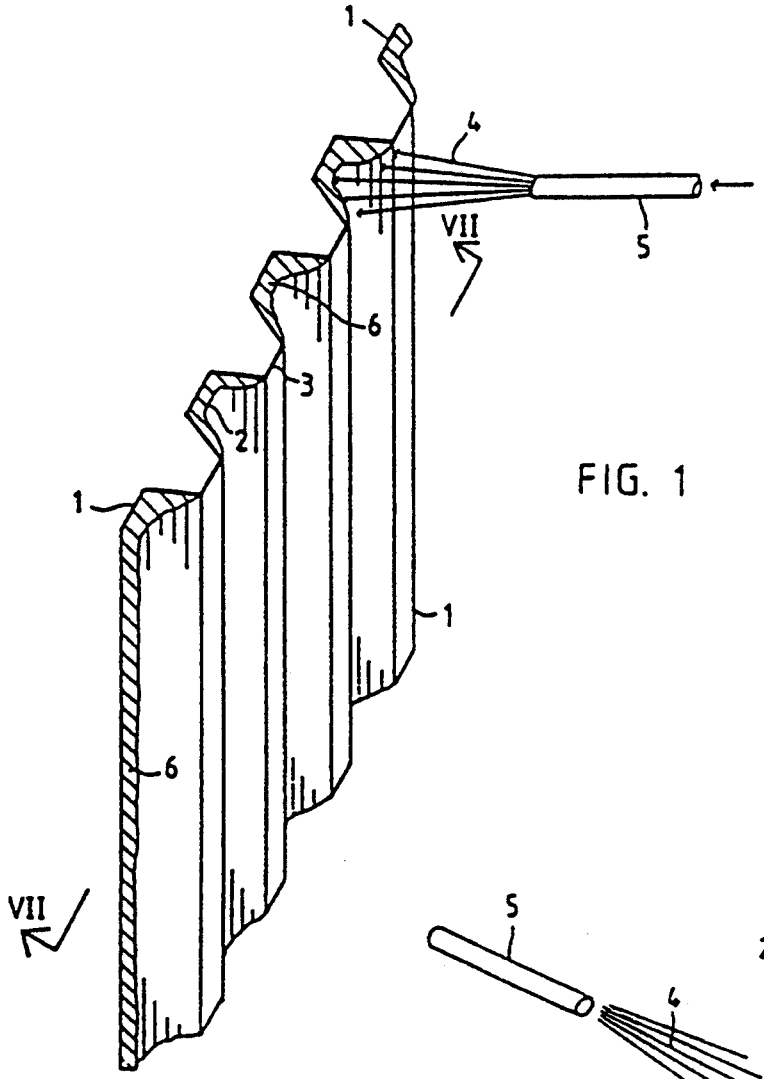
FIG. 1 shows a perspective of one vertical profile structure of the invention at the injection or spraying stage.

FIG. 1 shows in principle the coating of a profiled plate 1 with concrete 6. The concrete is generally supplied by the application of pressure from a pipe 5 towards profile plate 1, having regions of valleys 2 and ridges 3, as seen from the spraying side. A concrete layer 6 is usually first deposited on the bottom of valleys or recesses 2, with a concrete spray 4 deflecting from the inclined faces of profile plate 1. The profile plate 1 is generally and preferably made of steel. Thus, the adhesion of concrete 6 to the surface of profile plate 1 can be promoted by making profile plate 1 temporarily magnetic by means of an electromagnet and by spraying on to plate 1 a concrete mass which contains magnetizable particles, e.g. filings or steel fibers. In FIG. 1 the profile plate is shown in a vertical position, e.g. for building a fence, a wall structure or a noise barrier. The structure can also be set in a horizontal or inclined position. In the case shown in FIG. 1, the ridge sections 3 can also be coated with concrete 6.

Figure 2:
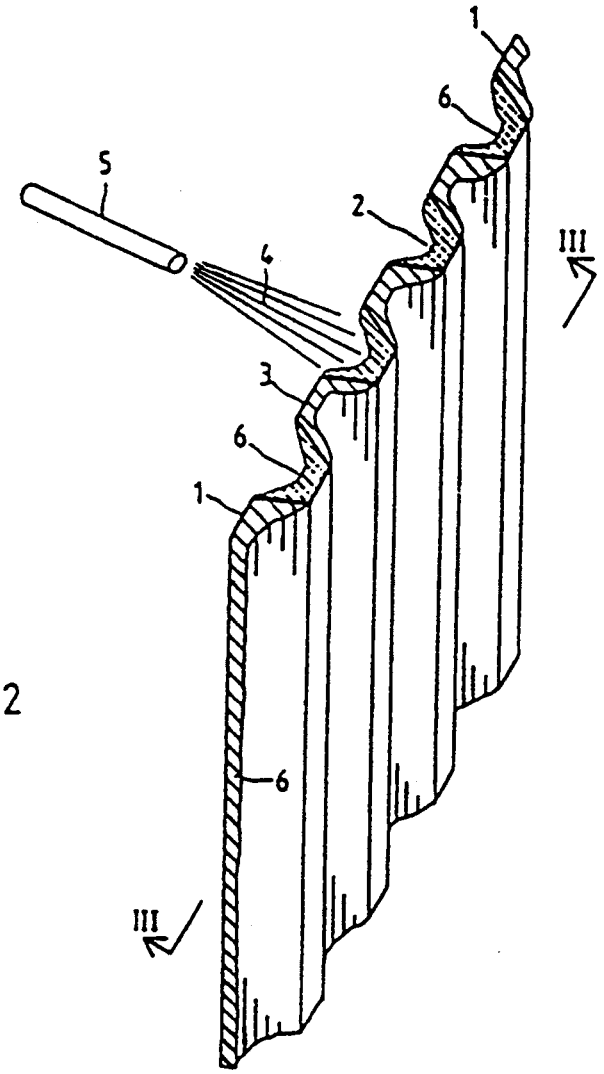
FIG. 2 shows the vertical profile structure of FIG. 1 from the other side during the injection or spraying stage.

FIG. 2 shows the spraying of the concrete to the opposite side of a profile plate 1. Thus, over the entire length of plate 1 there is obtained a composite structure, reinforced with concrete 6 and in which only the valley sections 2 are shotcreted.

Figure 3:
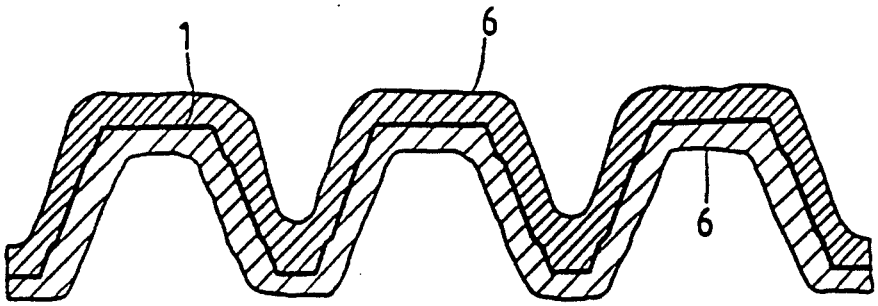
FIG. 3 is a horizontal cross-section along the line III—III of FIG. 2.

FIG. 3 shows in cross-section a composite structure, wherein both sides of profile plate 1 are coated with a shotcrete layer 6, which substantially conforms to the basic configurations of profile plate 1. Thus, a steel profile plate is protected from corrosion with an alkalite concrete. At the same time, the vertical flexural rigidity of the structure has increased to exceed considerably that of a mere profile plate 1. The structure shown in FIG. 3 can be used as a single noise barrier.

Figure 4:
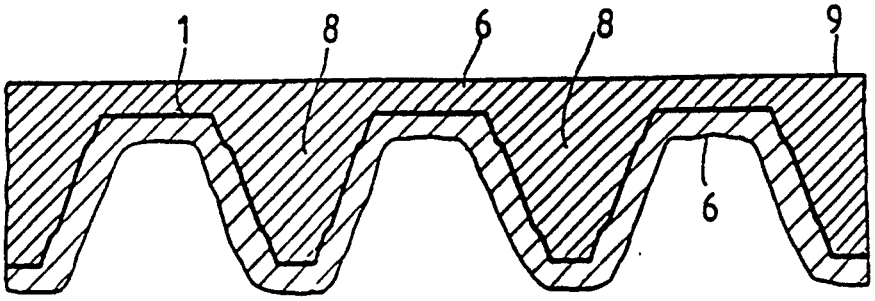
FIG. 4 shows one alternative horizontal cross-section along the line III—III of FIG. 2.

In FIG. 4, one of the concrete surfaces of the composite structure is shaped as a flat surface 9, e.g. for the facade of a building. The flat surface 9 can be made by levelling a moist shotcrete surface right after spraying. As an alternative, it is possible to employ temporarily a flash mold, (not shown) whereby spraying 4 is effected in vertical direction generally from above in between profile plate 1 and a flash mold. The resulting structure is provided with sturdy pillars 8 on one side of profile plate 1, while the principal configuration of the other side is left to follow profile plate 1 and to be lightweight due to the recesses.

Figure 5:
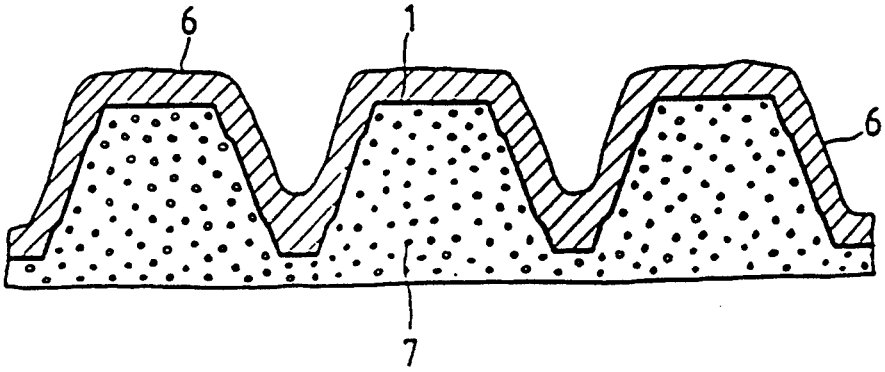
FIG. 5 shows a second alternative horizontal cross-section along the line III—III of FIG. 2.

FIG. 5 shows a horizontal cross-section of a structure, wherein one side of profile plate 1 carries a robust shotcrete layer 6 of e.g. fibrous concrete, and the other side is provided with porous concrete 7. The illustrated structure can serve as a noise barrier in a manner that the porous concrete layer 7 is positioned to face the noise for absorbing sound waves and the sturdy other side 6 holds the structure upright e.g. against wind forces. Even on the side of porous concrete, it is possible to spray additional strong concrete 6, if required by strength.

Figure 6:
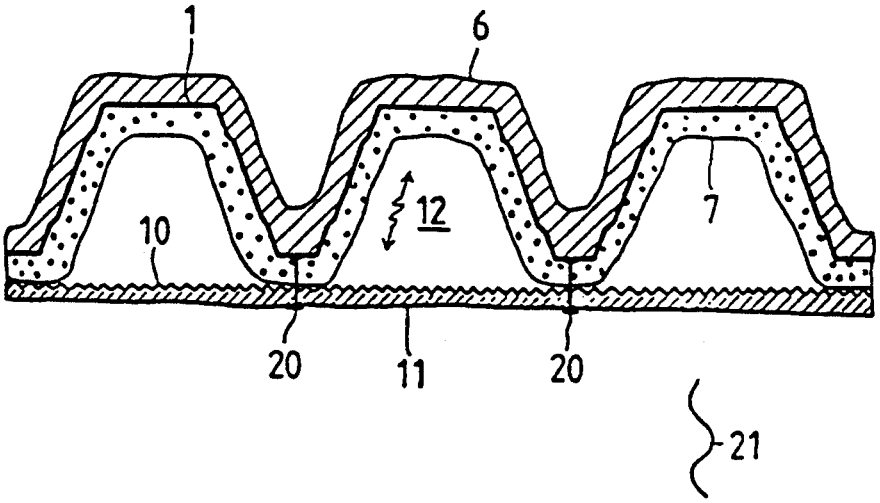
FIG. 6 shows a third alternative cross-section in a structure of the invention.

FIG. 6 illustrates a horizontal cross-section of a noise barrier according to the invention, wherein on one side of a profile plate there is sprayed a layer 7 of porous concrete. The structure is then fitted with clamps 20 for fastening a mesh or a non-woven fabric 10 on which is sprayed a thin layer of fibrous concrete mass or a cement glue 11 The incoming noise wave 21 is able to penetrate through thin concrete layer 11 and mesh 10 into intrastructural cavities 12 in which the noise is trapped as an echo and gradually disappears into porous concrete layer 7.

Figure 7:
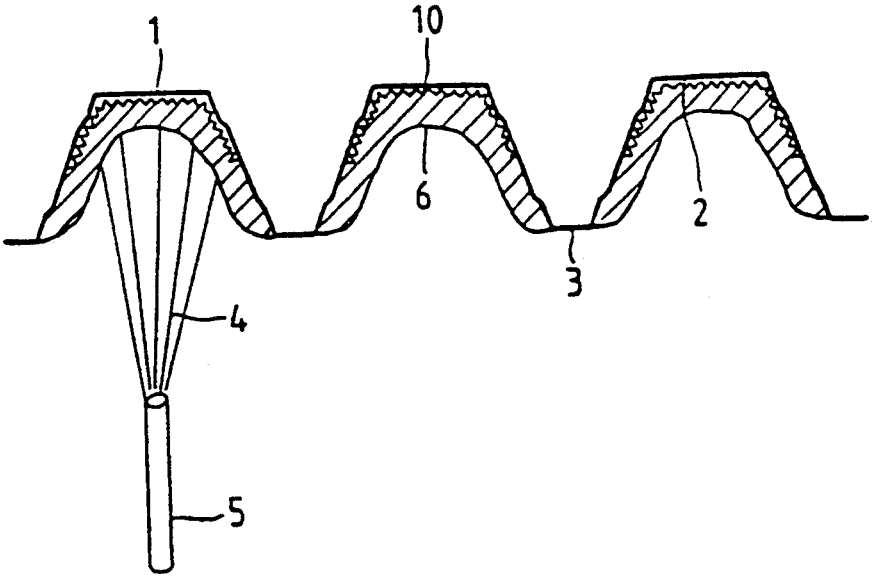
FIG. 7 shows one possible horizontal cross-section along the line VII—VII of FIG. 1.

FIG. 7 shows in a cross-section an embodiment, wherein the valley regions 2 of profile plate 1 are provided with meshes 10 for promoting the adhesion of shotcrete mass 6 to the surface of profile place 1. The meshes 10 can be made of a thin steel sheet, by cutting an expanded metal sheet, the elongation of which forms holes for the penetration of the concrete mass thereinto. It is also possible to use conventional concrete meshes. The first concrete sprayed onto profile plate 1 and the mesh, should be preferably applied at a low pressure or at a spraying distance longer than normal, so that the sprayed mass does not bounce off the flat surface. The rugged configuration of mesh 10 improves the situation, e.g. in the case of an expanded metal sheet. The mesh 10 can remain loose at the valley regions 2 of a profile plate or it can be temporarily attached magnetically by magnetizing a profile plate 1 with an electromagnet, e.g. on the side opposite to the spraying side for the duration of spraying. The mesh 10 can also be attached to profile plate 1 by means of rivets, welding or wire bindings. If necessary, the profile plate 1 can be entirely coated with mesh 10 even on both sides prior to spraying, As soon as an even thin layer 6 of concrete has been adhered to the surface of profile plate 1, it will be easy to add concrete 6 thereon. The gripping characteristics of fresh concrete 6 are excellent.

Figure 8:
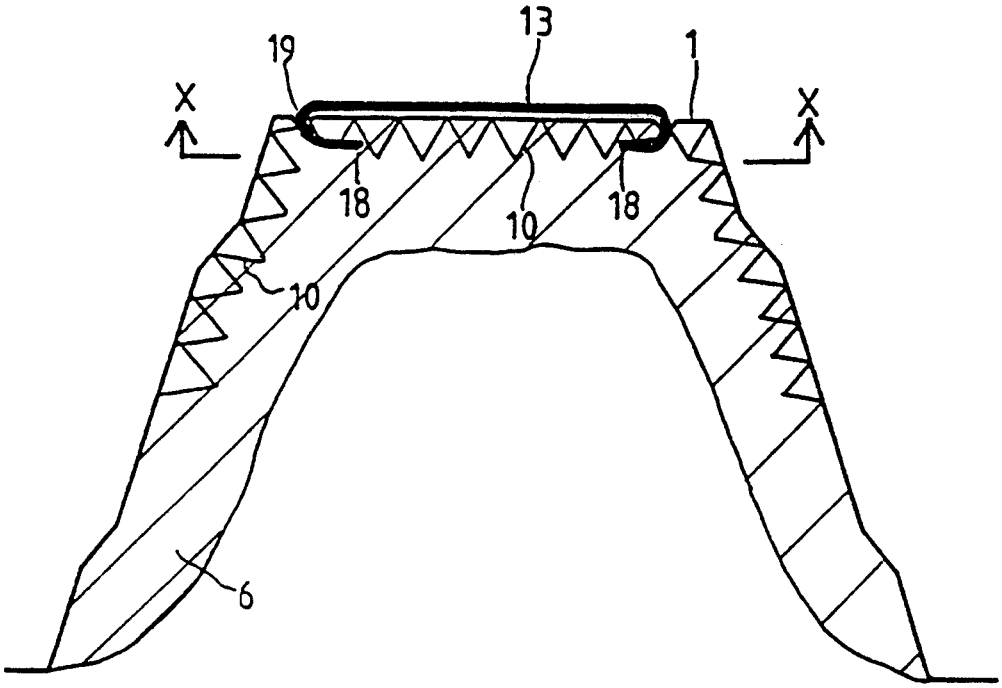
FIG. 8 is an enlarged view of one alternative detail of the horizontal section in FIG. 7.
Figure 9:
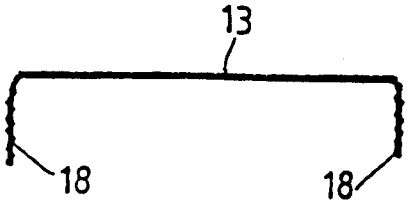
FIG. 9 illustrates the securing clip of FIG. 8, prior to attachment.

FIG. 8 shows how mesh 10 as secured to profile plate 1 by means of a clip 13, which is pressed through profile plate 1 via holes 19 and bent to have the ends 18 facing towards each other for binding mesh 10 firmly to profile plate 1.

FIG. 1 shows one configuration of a clip prior to placement through profile plate 1. The clip ends 18 can be threaded for improving the gripping in the concrete.

FIG. 10 illustrates a cut-out mesh 10 secured by means of plate-like clips 13 to the profile plate 1. The mesh of expanded metal sheet includes uncut portions 17 having a high tensile strength, especially in the non-elongated mesh direction 16. The mesh is preferably placed in a manner that the major tensile stresses in the structure will extend in direction 16. Generally this direction is the direction of ridges 3 and valleys 2. Thus, mesh 10 adds to the strength of the composite structure.

FIG. 11 illustrates another embodiment, wherein the ends of mesh 10 are pressed into recesses 14 in profile plate 1, for securing the mesh more firmly in position. The recesses 14 serve also to prevent detachment of finished concrete from profile plate 1, since the crosswise recess surfaces 31 are subjected to compressive forces. A concrete layer 6 obtained after spraying, serves in a way as a compression pillar 77, which is reinforced with mesh 10 and acts between the extensive basic configurations of the profile plate and generally minor crosswise portions 31. The pillars 77 are just imaginary structural components. In reality, they are just parts of the larger concrete mass. The crosswise portions 31 and mesh 10 are of major importance in terms of holding profile plate and concrete layer together. If necessary, there may be a dense pattern of crosswise portions 31 in the profile plates.

FIG. 12 shows another embodiment similar to that of the preceding figure, which is further provided with a spring 15 for improving the retention of mesh 10, the spring presses the mesh into recesses 14. The mesh 10 itself can also be designed as a spring.

Figure 13:
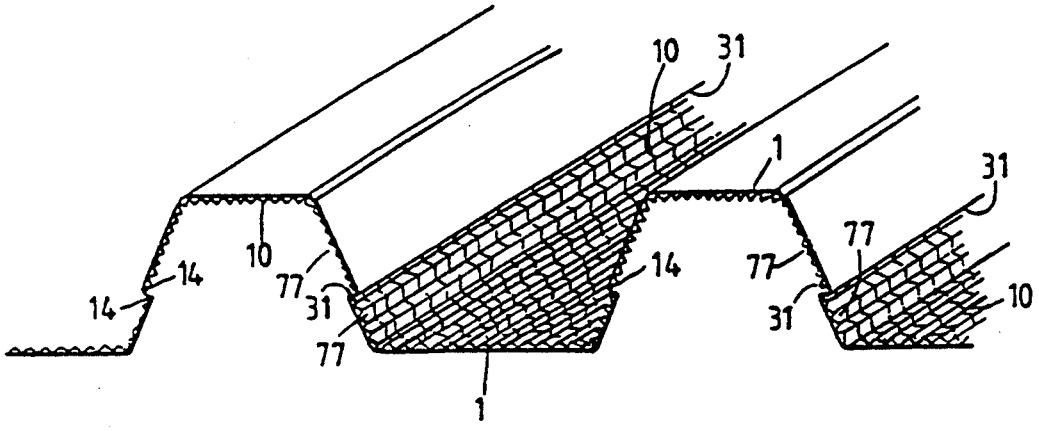
FIG. 13 shows one structure of the invention, prior to injection.

FIG. 13 illustrates another embodiment, wherein meshes 10 are mounted on different sides of profile plate 1, the ends of the meshes abutting against each other from different sides of crosswise faces 31. Thus, the reinforced successive concrete pillars 77 produced during spraying can also be made to lean on each other as a result of compressive forces.

Figure 14:
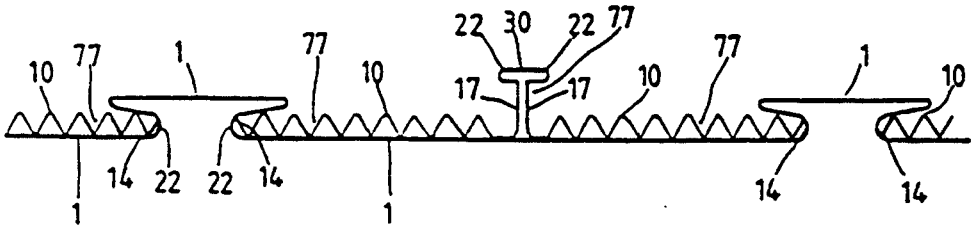
FIG. 14 is a cross-sectional view of the fastened meshes prior to injection.

FIG. 14 shows still another embodiment, wherein a mesh 10 is attached to recesses 14 of profile plate 1 by pressing the profile plate 1, on either side of recesses 14, firmly around mesh 10. The uncut portion 17 of expanded metal sheet mesh 10 is bent to extend outwards from the profile plate and collapsed towards profile plate 1, so as to provide the mesh 10 with lateral extensions 22 on either side of a portion 30 extending in the same direction as profile plate 1. The profile plate extensions 22 bind mesh 10 in a subsequently made concrete layer. If necessary, strong mesh 10 can serve even as a substantial reinforcement in a structure. In this case, the imaginary pillar 77 is partially horizontal and partially vertical. The adjacent lateral extensions 22 of a profile plate can be brought into contact with each other, whereby the imaginary pillars 77 push each other during pressing.

Figure 15:
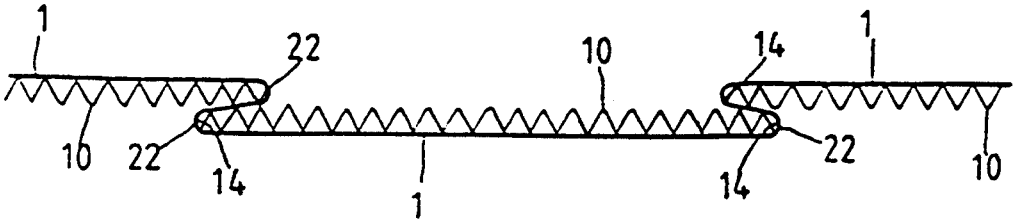
FIG. 15 shows in cross-section another way of fastening the meshes prior to injection.

FIG. 15 shows an embodiment, wherein meshes 10 are mounted on either side of profile plate 1 by pressing together adjacent recesses 14 and the parts of profile plate 1 therearound.

Figure 16:
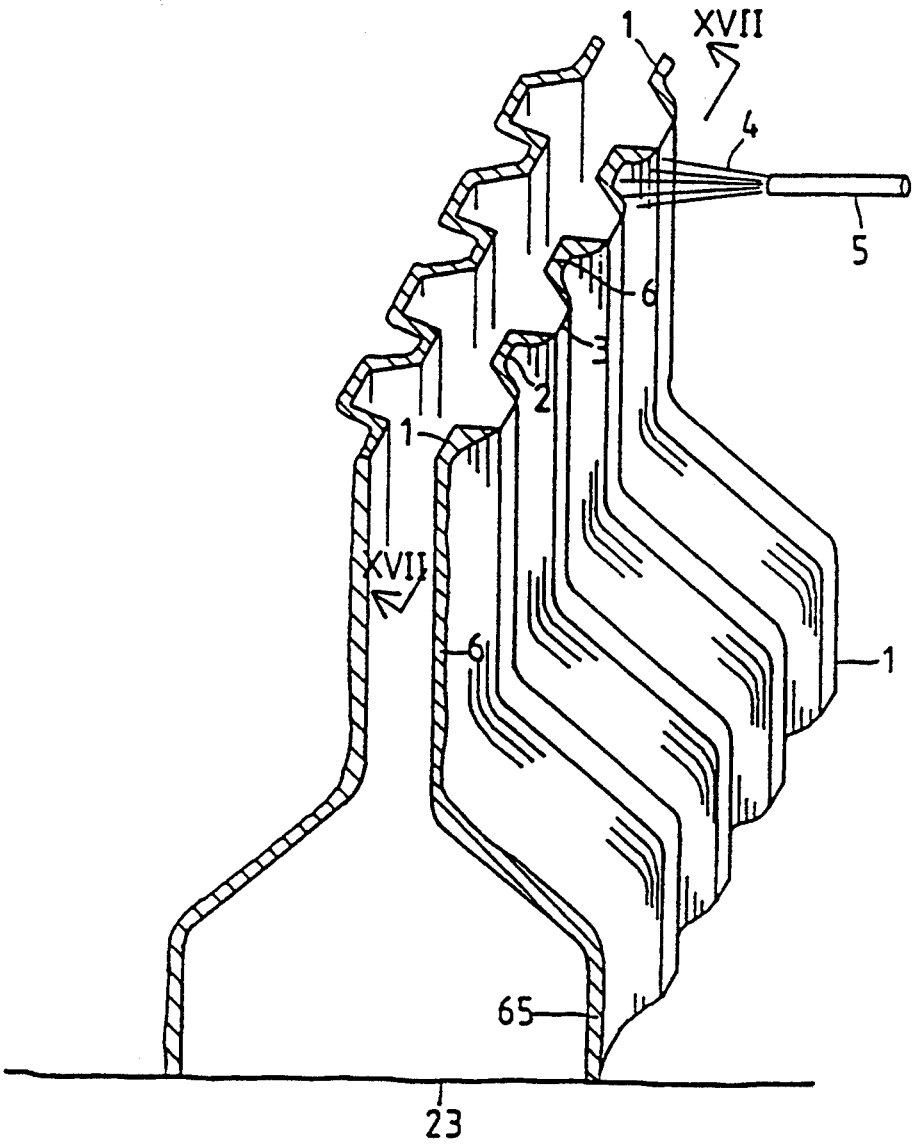
FIG. 16 shows a foundation or support wall structure of the invention at the injection stage.

FIG. 16 illustrates a foundation of the invention, wherein profile plate 1 is coated by spraying thereon a concrete layer 6 for increasing the strength of the profile plate as a casting mold at a subsequent stage. By increasing the width of a footing 65 with subsoil 23 in a one-sided manner, it is also possible to create a support wall that can be filled with cast concrete, if desired. Prior to casting, the separate halves made by shotcreting are bound to each other, e.g. with steel clamps. FIG. 16 can also be applied when building a platform structure.

Figure 17:
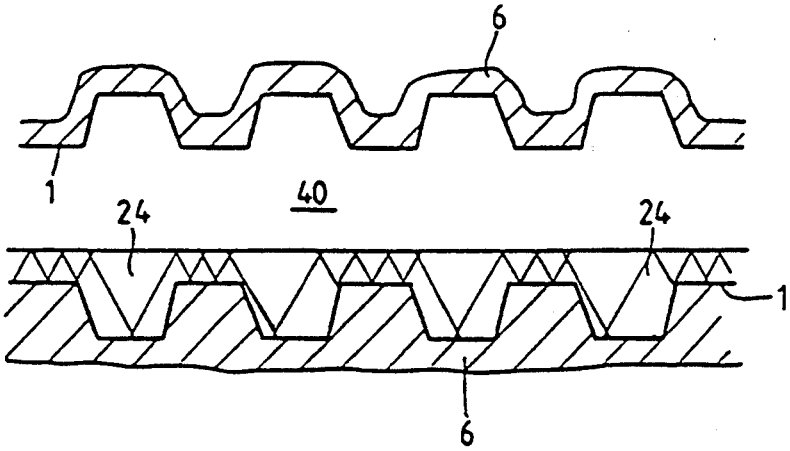
FIG. 17 shows one possible cross-section along the line XVII—XVII of FIG. 16, after the injection.

FIG. 17 shows a horizontal cross-section of a foundation provided with heat insulation 24 on one side of the profile plate. An intermediate space 40 in the foundation can be filled in a per se known manner with cast concrete.

Figure 18:
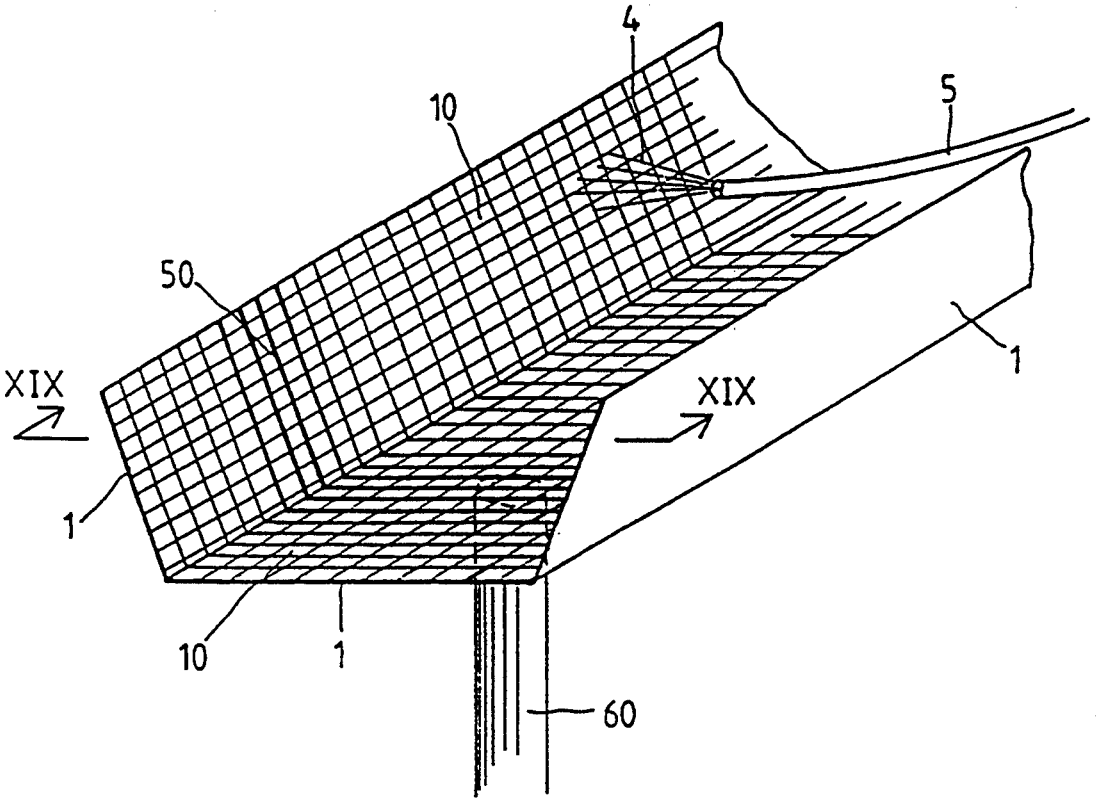
FIG. 18 shows one bridge structure of the invention during injection.

FIG. 18 illustrates a bridge structure of the invention, wherein a bridge-bearing structure is made by gradually adding layers of shotcrete on top of a profile plate 1.

Profile plate 1 serves initially as a mold and a stand for the structure. A profile plate 1 can be pre-assembled into a configuration corresponding to a bridge structure, and alongside the working site into a large-size structure. The assembly of a desired profile plate 1 can be performed by using profile plate elements, supported e.g. on the ground, ice or pontoons. Profile elements can be linked together by per se known methods, e.g. by means of rivets, spot welding or screws. A profile plate unit 1 corresponding to the structure is carried over to rest on bridge supports 60. The thin sheet structure is relatively light so the transfer of even large structural components is possible. During the transfer, the concrete layers increasing the weight of a structure are not yet present in substantial amounts. Even during the transfer, it is possible that a profile plate has attached thereto some steel meshes 10 or special bracings 50 for increasing strength during the transfer. When the profile plate structure serves as a mold and a stand for a large-size bridge, the strength for the duration of work can be increased by means of temporary diagonal cables or other strut arrangements until the structure has reached a sufficient inherent strength. The extensive surface of profile plate 1 is preferably provided with suitable profiled shapes for increasing rigidity, particularly prior to the reinforcing effect of the concrete.

A concrete structure for the actual bridge is generally sprayed only after setting profile plate 1 in position or nearly in position. The spraying sequence can be planned in a manner that there are first formed strength-increasing layers adjacent to supports 60. Generally, these concrete layers are allowed to set before the spraying is continued elsewhere. Between various concrete layers it is possible to include reinforcement meshes 10 as planned in a manner that the spots under the severest stresses are provided with the most reinforcement meshes 10 or the meshes are stronger at these spots. Also prestressed cables can be fitted between various shotcrete layers for increasing the strength of a finished structure. For improving the strength of profile plate unit 1 for the transfer, it is possible to spray a certain amount of concrete onto suitable spots of profile plate 1 even before the transfer.

Figure 19:
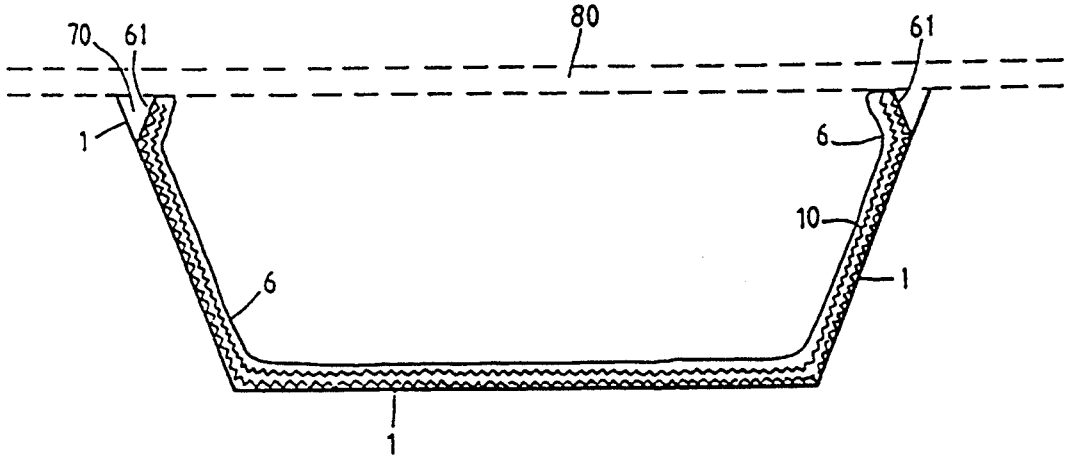
FIG. 19 shows one possible cross-section along the line XIX—XIX of FIG. 18.

FIG. 19 illustrates a cross-section of a bridge of the invention. The upper edge of a profile plate 1 is provided with profile plate extensions 61 in a manner that between extension 61 and profile plate 1 there will be a chute-like space 70. This chute-like space 70 can be filled with concrete to increase the strength of the edge of profile plate 1. The reinforcement of chute-like space 70 with concrete can be done even before transferring the load-bearing structure to its final position. FIG. 19 shows meshes 10 fitted between various shotcrete layers. The concrete-filled chute-like spaces 70 serve as junctions between a bridge deck 80 and the load-bearing structure. The bridge deck 80 can be built by the method of the invention e.g. on top of a profiled plate which is placed crosswise relative to the load-bearing structure of the bridge. Thus, the chute-like spaces 70 can be fitted with catching means between load-bearing structure and deck 80. The bridge deck 80 can also be made traditionally by using elements or by casting in situ.

Figure 20:
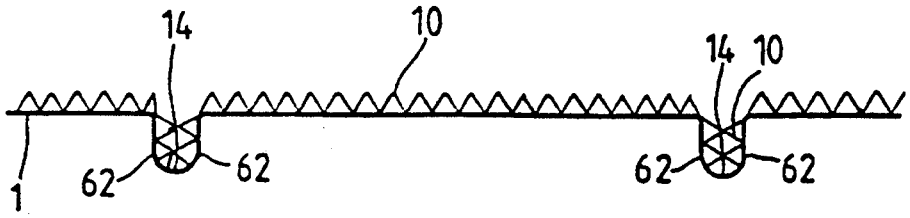
FIG. 20 shows in cross-section a third way of fastening the meshes, prior to pressing the recesses together.
Figure 21:
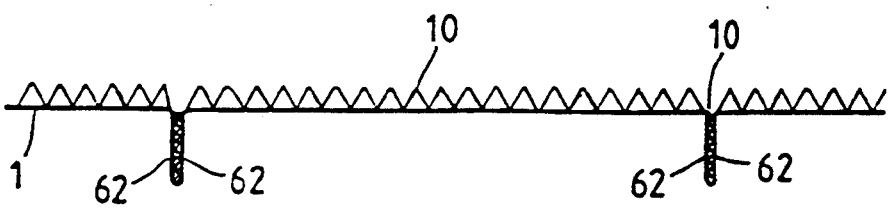
FIG. 21 is a cross-sectional view of FIG. 20, after pressing the recesses together.

FIG. 20 shows an embodiment, wherein a mesh 10 which promotes the adhesion of shotcrete 4 to the surface of profile plate 1, is fitted in recesses 14 of a flat profile plate 1. The side walls 62 of recesses 14 can be pressed together as shown in FIG. 21 for securing the mesh firmly between walls 62. Thus, a mesh 10 remains tightly secured to profile plate 1, preventing the detachment of a subsequently made shotcrete layer from profile plate 1. The uncut sheet portions of a mesh can be bent into recesses 14 and pressed tightly between side walls 62, The adhesion of concrete to the surface of a profile plate 1 at the initial stage of spraying can also be promoted by toughening the profile plate surface e.g. by means of a large number of ragged-edged perforations or knurls.

Figure 22:
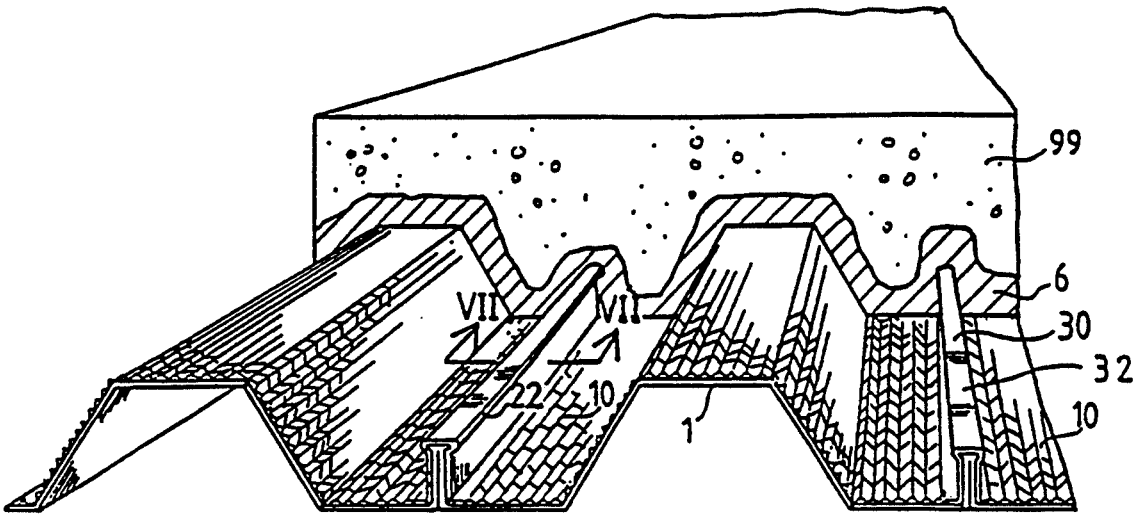
FIG. 22 shows a detailed view of one composite structure of the invention.

FIG. 22 shows in a perspective, one composite structure of the invention, wherein joint profiles 32 are horizontal and parallel to the profiles of plate 1. On top of profile plate 1 and a mesh 10 there is sprayed a rather thin layer of concrete 6, which, upon setting, gives the structure such a strength that a heavier concrete mass 99 can be cast without special support systems. Side extensions 22 and mesh 10 together serve to hold the concrete firmly secured to profile plate 1 in a manner that its tensile strength can be fully utilized. The joint profiles 32 can also be made on different levels, if desired. As seen from the side, a surface 30 can be corrugated in a vertical direction, whereby the width of side extensions 22 may vary. Thus, the plate elements cannot move relative to each other. If desired, the structure can be prestressed by drawing profile plate 1 and mesh 10 in the direction of the shaped profiles during casting, the steels 10 and 1 subsequently creating in concrete 6 and 99 a compressive force for increasing its strength. Particularly, the shapes of expanded metal sheet 10 make the prestressing possible, as steel is not able to slide relative to concrete.

Figure 23:
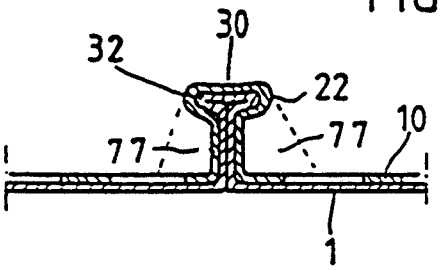
FIG. 23 shows one possible cross-section along the line VII—VII of FIG. 22, prior to the addition of concrete mass.

FIG. 23 shows one possible cross-section along the line VII—VII of FIG. 22, prior to the application of concrete. Between a joint profile 32 and plate elements 1 and 10, there forms after concreting, a pillar-shaped compression zone 77, wherein the concrete through its compressive strength retains the plate structure firmly in the concrete mass.

Figure 24:
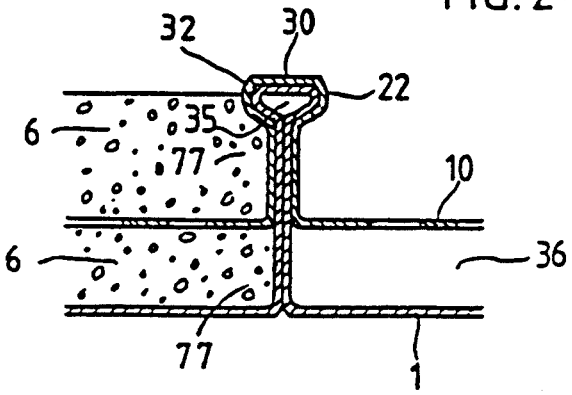
FIG. 24 shows one alternative cross-section along the line VII—VII of FIG. 22, after the partial addition of concrete mass.

FIG. 24 shows an alternative cross-section along the line VII—VII of FIG. 22. In this case, the corrugations of plate elements 1 and 10 are dimensioned to leave a space 36 between the extensive portions of the plate elements. Through the apertures of expanded metal sheet 10, concrete 6 can also fill space 36 for building a pillar-like compression zone 77 therein, the same way as below joint profile 32. By placing an expanded metal sheet 10 further away from profile plate 1 the stresses can be distributed in concrete mass 6 over a larger area. In the case of FIG. 24, there is an empty space 35 inside the joint profile 32, which can be formed by not extending the side extensions 22 the entire width.

Figure 25:
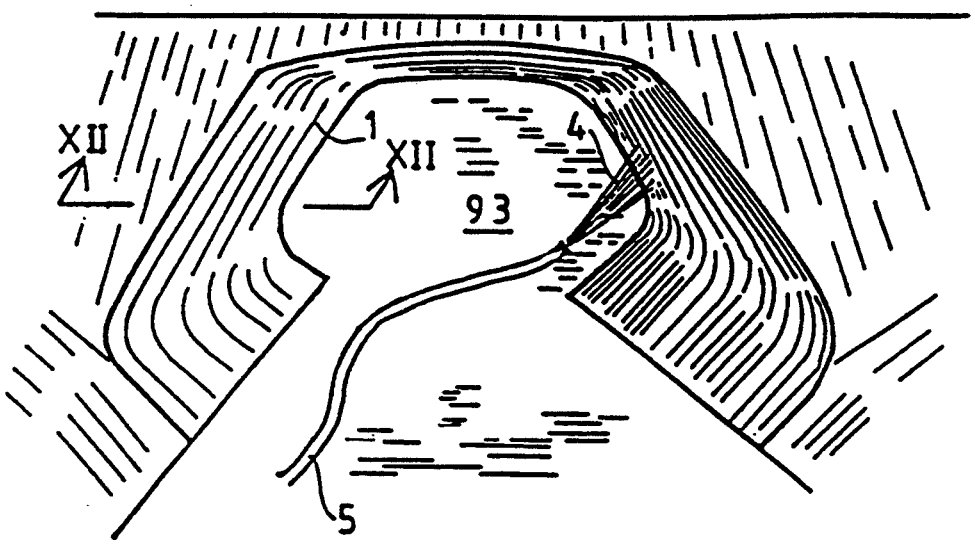
FIG. 25 shows a detailed view of one bridge embodiment of the invention.

FIG. 25 illustrates one embodiment of a bridge according to the invention at the installation stage, as the internal plate surface 1 of a bridge opening 93 is being coated with shotcreting. For example, a rim bridge for pedestrian and bicycle traffic or a culvert for the passage of water. The shaped profiles of profile plate 1 are arranged in the direction of the cross-section to give the structure as much rigidity as possible in that direction against various loads. In principle, FIG. 25 can also depict a large subway for vehicle traffic. The same way, it is even possible to build a tunnel-shaped noise barrier over a traffic route.

Figure 26:
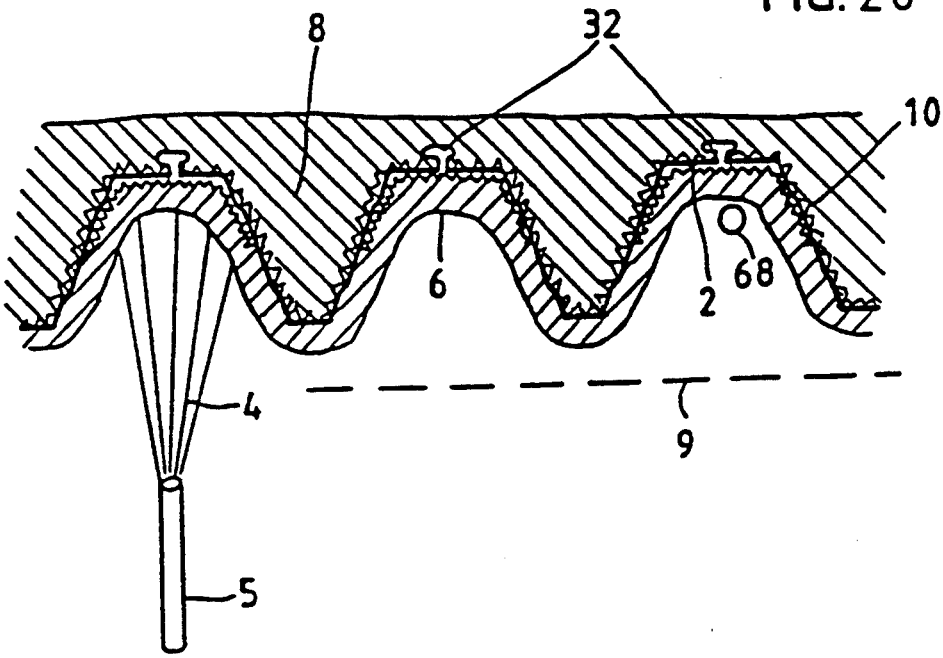
FIG. 26 shows one possible horizontal cross-section along the line XII—XII of FIG. 25.

FIG. 26 shows a horizontal section along the line XII—XII of FIG. 25. This illustrates more clearly the valley regions 2 of profile plate 1, in which a concrete spray 4 most readily penetrates. A concrete mass supply pipe 5 is shown in principle. Prior to coating the inside, it is preferable to shotcrete the outside of a structure with a concrete layer 8 before an external loading is added to the structure. The rim and culvert structures are primarily subjected to loads of compressive forces, so the concrete layers 6 and 8 are especially capable of taking up these stresses. In a conventional corrugated tube culvert, which is made of steel sheet, all stresses must be received on the steel plates. Thus, the thickness of the steel sheet becomes great and increases the costs. In the embodiment of the invention, the profile plate can be very thin and, hence, inexpensive. During the spraying operation, for example, it is possible to place under the concrete layers some various devices, such as electric cables or other wires 68, so that they will be hidden below the finished structure. The final surface can be made flat as shown by dashed line 9. In view of securing the concrete layers 6, 8 coated on different sides, it is preferable to employ meshes 10 fixed by means of joint profile 32 on both sides of profile plate 1.

Figure 27:
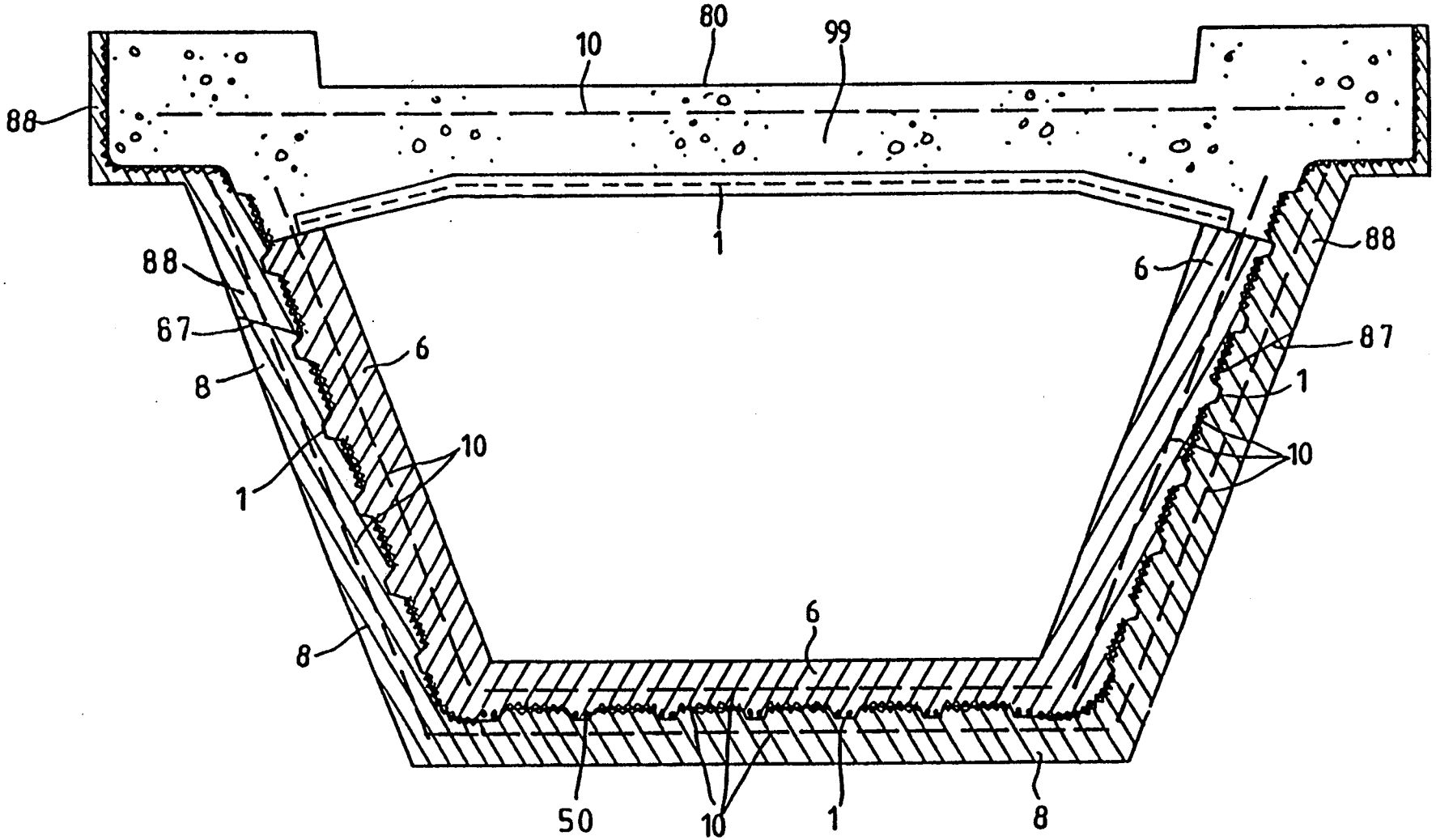
FIG. 27 shows a cross-section of another bridge embodiment of the invention.

FIG. 27 shows in principle a cross-section of another bridge of the invention. A profile plate 1 shaped as a bridge-bearing structure, e.g. a box beam, is first coated on the inside e.g. with a shotcrete layer 6 for increased strength. After layer 6 is set, the profile plate 1 above the box is fitted crosswise in position. At the same time it is possible to effect the reinforcement of the top section by means of an external shotcrete layer 88. After this is set, a bridge deck 80 can be cast by using cast concrete 99. Finally, the outside of the bottom section can be coated with a shotcrete layer 8. Between the outside surface layers 88 and 8 may remain a construction joint 87. If desired, it is possible to provide the bridge structure with upright strut means also in the middle of the box.

I claim:

1. A method for fabrication of a bridge from a composite structure, by combining profile plate and concrete, the method comprising the steps of:

(a) transporting and placing the profile plate at a bridge building site, the profile plate including means for securing the concrete on the profile plate;

(b) pre-assembling the profile plate into a configuration corresponding to a desired bridge structure, the pre-assembled profile plate being comprised of a light-weight, easily handled structure having a load bearing strength which is increased at the bridge building site;

(c) spraying a layer of concrete onto the securing means of said profile plate to increase the load bearing strength of the pre-assembled profile plate;

(d) allowing the layer of concrete to partially set;

(e) spraying another layer of concrete on said concrete layer to further increase the load bearing strength of the pre-assembled profile plate ; and repeating steps (c) through (e), to apply a plurality of layers of concrete on said profile plate until the desired bridge structure is fabricated.

2. A method as set forth in claim 1, wherein said profile plate is made of steel, and said steps (c) through (e) comprise spraying a first layer of concrete onto the steel profile plate, allowing the first layer to set, and thereafter spraying at least a second layer of concrete onto the first layer of the set concrete.

3. A method as set forth in claim 1, further comprising the step of placing reinforcing iron or steel between the layers of sprayed concrete.

4. A method as set forth in claim 3, wherein said steps of spraying comprise spraying concrete of different quality into selected ones of the plurality of layers of concrete.

5. A method as set forth in claim 1, wherein said profile plate has opposed sides and said steps of spraying comprise spraying concrete onto both sides of said profile plate.

6. A method as set forth in claim 1, wherein the concrete comprises concrete mixed with fibers.

7. A method as set forth in claim 1, wherein the concrete being sprayed comprises concrete mixed with porous granules.

8. A method as set forth in claim 1, wherein said securing means comprises a plurality of ragged-edged perforations on said profile plate, and the step of spraying concrete onto said securing means comprises spraying said concrete layer onto the plurality of ragged-edged perforations.

9. A method as set forth in claim 1, wherein said securing means comprises a mesh fitted on said profile plate, and the step of spraying concrete onto said securing means comprises spraying said concrete layer on said mesh.

10. A method as set forth in claim 9, wherein said securing means comprises a plurality of valley regions on said profile plate and said mesh is secured to said plurality of valley regions of said profile plate, and the step of spraying concrete onto said securing means spraying said concrete layer on said mesh.

11. A method as set forth in claim 9, wherein said securing means includes a plurality of clips having ends, the ends of said clips being pressed into said profile plate to secure the mesh on said profile plate.

12. A method as set forth in claim 9, wherein said mesh has ends and said securing means comprises a plurality of recesses on said profile plate and the ends of said mesh are secured in the recesses of said profile plate.

13. A method as set forth in claim 12, wherein said mesh ends are secured in the recesses of said profile plate by a spring.

14. A method for fabrication of a bridge from a composite structure, by combining a profile plate and concrete, the method comprising the steps of:

(a) transporting and placing the profile plate at a bridge building site, the profile plate including a mesh fitted on said profile plate;

(b) pressing said profile plate around a portion of said mesh to secure said mesh on said profile plate;

(c) pre-assembling the profile plate into a configuration corresponding to a desired bridge structure, the pre-assembled profile plate being comprised of a light-weight, easily handled structure having a load bearing strength which is increased at the bridge building site;

(d) spraying a layer of concrete onto the mesh of said profile plate to increase the load bearing strength of the pre-assembled profile plate; and (e) allowing the layer of concrete to partially set;

(f) spraying another layer of concrete on said concrete layer to further increase the load bearing strength of the pre-assembled profile plate; and repeating steps (d) through (f), to apply a plurality of layers of concrete on said profile plate until the desired bridge structure is fabricated.

15. A method for fabrication of a bridge from a composite structure, by combining a profile plate and concrete, the method comprising the steps of:

(a) transporting and placing the profile plate at a bridge building site, the profile plate including a mesh fitted on said profile plate, wherein said profile plate includes a plurality of recesses;

(b) pressing sides of said recesses together to fold said mesh in the recesses of said profile plate to secure said mesh on said profile plate;

(c) pre-assembling the profile plate into a configuration corresponding to a desired bridge structure, the pre-assembled profile plate being comprised of a light-weight, easily handled structure having a load bearing strength which is increased at the bridge building site;

(d) spraying a layer of concrete onto the mesh of said profile plate to increase the load bearing strength of the pre-assembled profile plate;

(e) allowing the layer of concrete to partially set;

(f) spraying another layer of concrete on said concrete layer to further increase the load bearing strength of the pre-assembled profile plate; and repeating steps (d) through (f), to apply a plurality of layers of concrete on said profile plate until the desired bridge structure is fabricated.

16. A method as set forth in claim 15, wherein said profile plate is folded to produce a plurality of lateral extensions, each having a varying width.

17. A method for fabrication of a bridge from a composite structure, by combining a plurality of profile plates and concrete, the method comprising the steps of:

(a) transporting and placing the plurality of profile plates at a bridge building site, each of the profile plates including means for securing the concrete on the profile plates;

(b) assembling the plurality of profile plates into a configuration corresponding to a desired bridge structure, the assembled profile plates being comprised of a light-weight, easily handled structure having a load bearing strength which is increased at the bridge building site;

(c) spraying a layer of concrete onto the securing means of said assembled profile plates to increase the load bearing strength of the assembled profile plates;

(d) allowing the layer of concrete to partially set;

(e) spraying another layer of concrete on said concrete layer to further increase the load bearing strength of the assembled profile plates; and repeating steps (c) through (e), to apply a plurality of layers of concrete on said assembled profile plates until the desired bridge structure is fabricated.

* * * * *